US006751892B2

(12) United States Patent
Chavet et al.

(10) Patent No.: US 6,751,892 B2
(45) Date of Patent: Jun. 22, 2004

(54) MINEFIELD SHOE AND METHOD FOR MANUFACTURE THEREOF

(75) Inventors: Itzchak Chavet, Rechovot (IL); Avichai Madmoni, Jerusalem (IL)

(73) Assignee: Achidatex Nazareth Elite (1977) Ltd., Rahat Gan (IL)

( * ) Notice: Subject to any disclaimer, the term of this patent is extended or adjusted under 35 U.S.C. 154(b) by 135 days.

(21) Appl. No.: 10/098,344

(22) Filed: Mar. 18, 2002

(65) Prior Publication Data

US 2003/0172554 A1 Sep. 18, 2003

(51) Int. Cl.[7] ..... A43B 3/00; A43B 3/10; A43B 3/12; A43B 13/20

(52) U.S. Cl. ..... 36/113; 36/7.5; 36/7.8; 36/7.1 R; 36/29

(58) Field of Search ..... 36/113, 88, 114, 36/7.8, 7.5, 116, 7.1 R, 29

(56) References Cited

U.S. PATENT DOCUMENTS

| | | | | | |
|---|---|---|---|---|---|
| 2,430,466 | A | | 11/1947 | Hedman | |
| 2,720,714 | A | * | 10/1955 | Krohn et al. | 36/29 |
| 3,423,852 | A | * | 1/1969 | Smith | 36/29 |
| 3,628,262 | A | * | 12/1971 | Stopek | 36/7.1 R |
| 4,525,941 | A | * | 7/1985 | Ruth, Jr. | 36/7.5 |
| 4,611,411 | A | | 9/1986 | Ringler et al. | |
| 4,676,009 | A | * | 6/1987 | Davis et al. | 36/7.5 |
| 4,779,359 | A | * | 10/1988 | Famolare, Jr. | 36/29 |
| 5,673,498 | A | * | 10/1997 | Amir et al. | 36/29 |
| 5,771,606 | A | * | 6/1998 | Litchfield et al. | 36/29 |
| 5,926,977 | A | * | 7/1999 | Sanders | 36/7.1 R |
| 6,453,577 | B1 | * | 9/2002 | Litchfield et al. | 36/29 |
| 6,519,797 | B1 | * | 2/2003 | Brubaker et al. | 36/29 |

FOREIGN PATENT DOCUMENTS

DE 3802416 A1 1/1988

* cited by examiner

*Primary Examiner*—Anthony D. Stashick
(74) *Attorney, Agent, or Firm*—Mark M. Friedman

(57) ABSTRACT

A minefield shoe for reducing the danger of accidental detonation of a land mine by a wearer of the shoe, the shoe including: (a) a cushion including a plurality of inflatable compartments, the cushion having, when inflated, at least one flexible, substantially flat, ground-contacting surface extending across the compartments; (b) passages, disposed within the cushion, for providing fluid communication between the compartments, and (c) means for attaching the shoe to a boot of the wearer, wherein each of the compartments is in fluid communication with at least one other compartment, via the passages, so as to prevent any significant increase in internal pressure of any one of the compartments resulting from a decrease in internal volume of another compartment, thereby to allow deformation of the ground-contacting surface to form a matching counterpart of terrain engaged by the shoe, while maintaining a substantially even distribution of the load on the shoe along all of the ground-contacting surface.

21 Claims, 5 Drawing Sheets

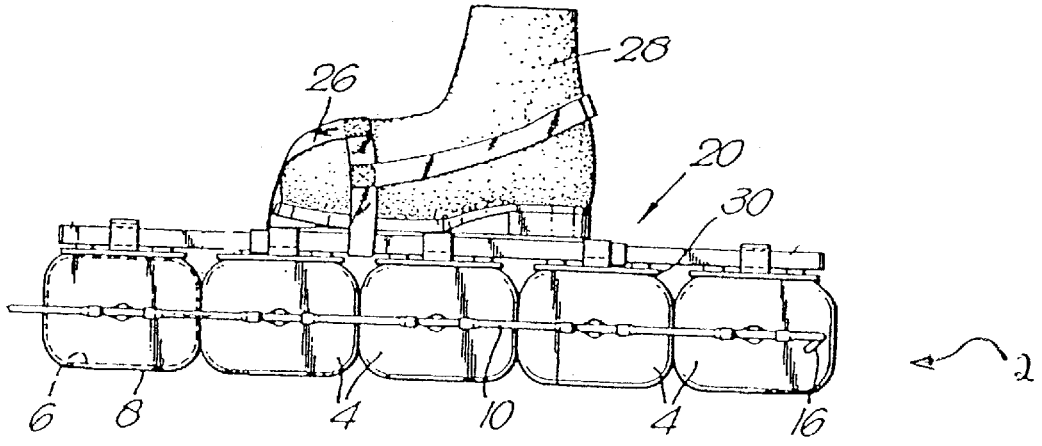
Fig 1
PRIOR ART
Fig. 2
PRIOR ART
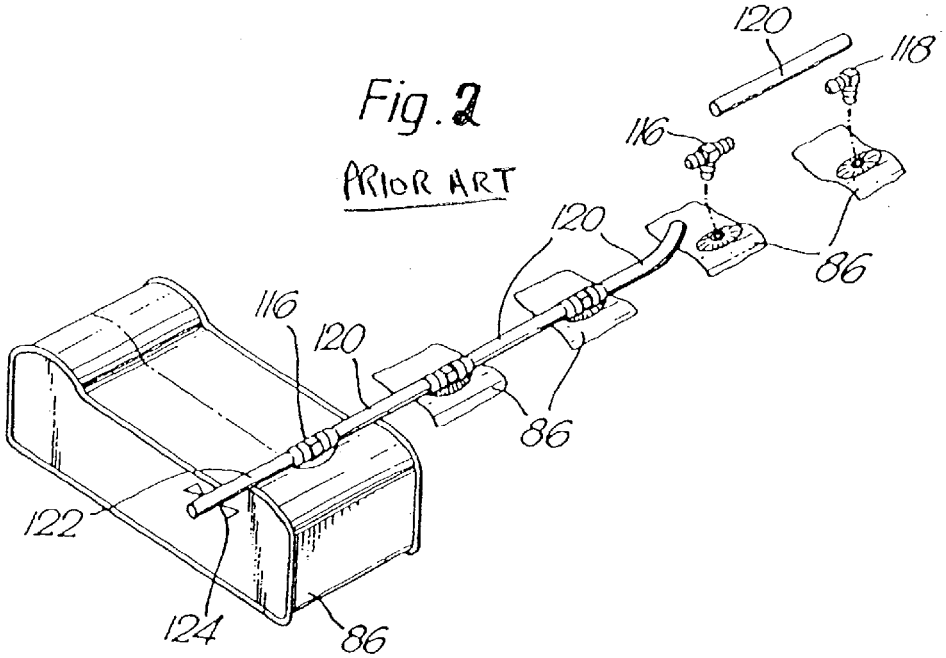

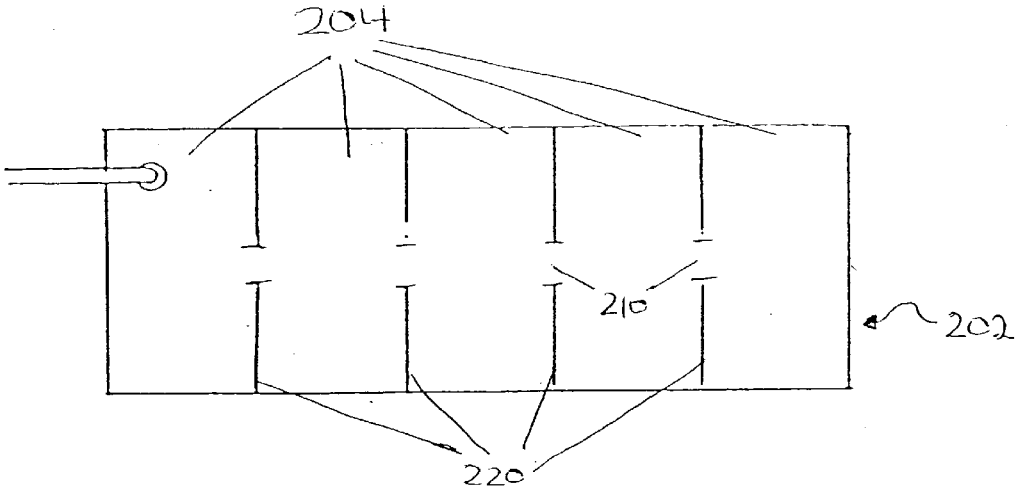
FIG. 3
FIG. 4a
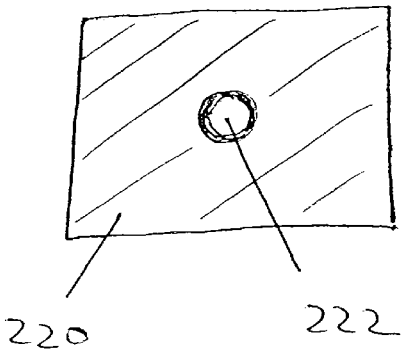
FIG. 4b
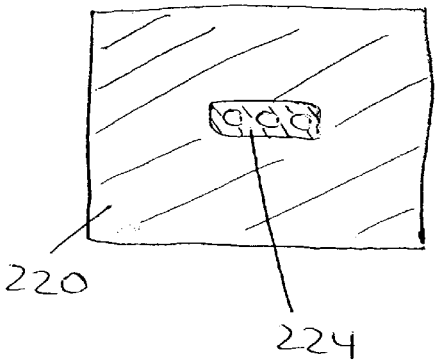

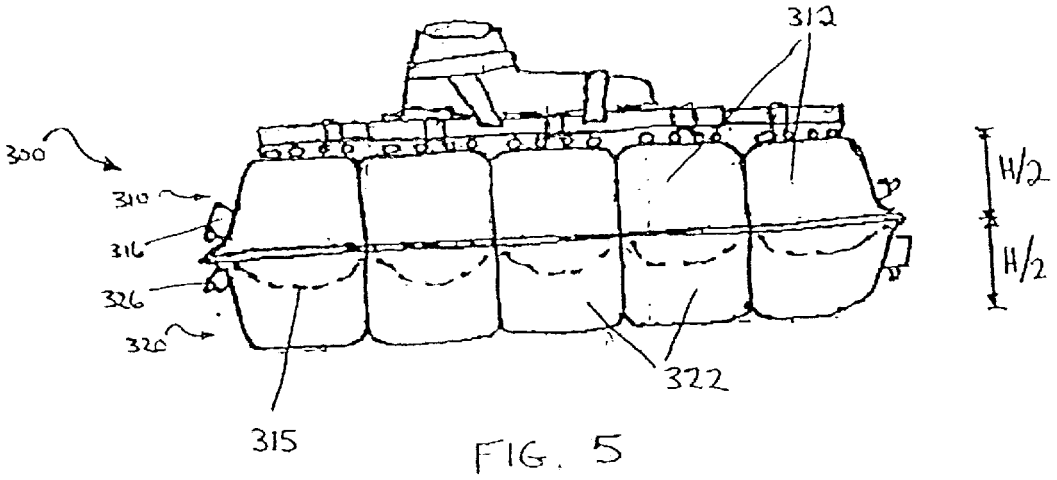
FIG. 5
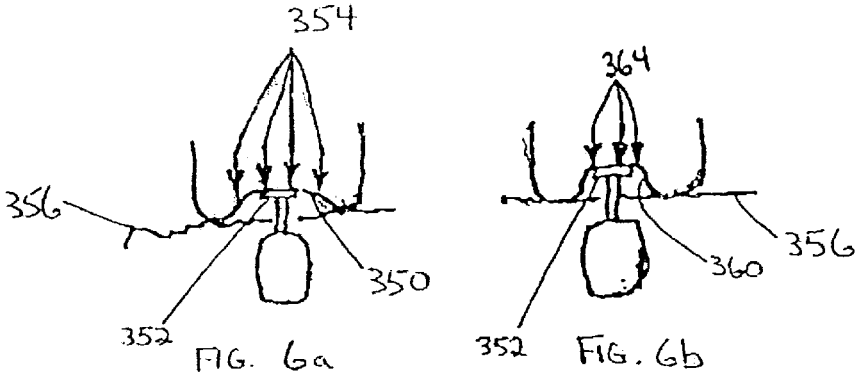
FIG. 6a FIG. 6b
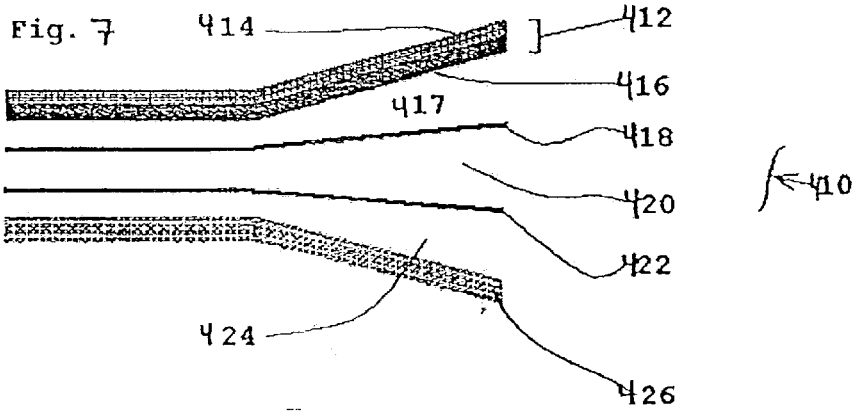

MINEFIELD SHOE AND METHOD FOR MANUFACTURE THEREOF

FIELD AND BACKGROUND OF THE INVENTION

The present invention relates to a device for reducing the danger of accidental detonation of a land mine and, more particularly, to a shoe for working safely in a minefield and to a method of manufacture thereof.

Land mines are usually detonated when a weight, exceeding a predetermined threshold, is applied thereon. The sensitivity to the detonation of a mine is governed, on the one hand, by the desire to provide a mine that will explode under the application of a minimal weight and, on the other hand, a mine that will not be accidentally detonated by small animals passing by, wind-blown debris, etc.

Similar to the snowshoe, which enables a wearer to walk on deep snow without sinking, it has been suggested to use a minefield shoe composed of a flat, rigid surface lined with a thick rubber or plastic foam, which, as it is understood, reduces the weight per unit area of the wearer on the ground. The main disadvantages, however, of such a minefield shoe are the difficulty of movement or walking due to the rigidity of the relatively large surface required for contacting the ground, and, of even greater importance, the fact that such shoes are effective only on smooth ground. On uneven ground or on ground having scattered stones, the weight of the wearer is no longer evenly distributed across the entire tread surface but is concentrated on the highest and limited points of contact between the ground and the contact surface of the shoe. Moreover, the rubber or plastic foam is rapidly worn down, requiring frequent replacement. Hence, this type of minefield shoe is not sufficiently safe and is of limited usefulness.

U.S. Pat. No. 4,611,411 to Ringler, et al., teaches a minefield shoe that displays improved performance in terms of ground contact. The minefield shoe disclosed contains an inflatable, multiple compartment air cushion. In contradistinction to the snowshoe-type minefield shoe, when the ground contacting surface of the air cushion presses against an uneven terrain or against a protrusion, a portion or portions of the surface move inwardly, the extent of which depends, inter alia, on the air pressure prevailing inside the compartment. Since the outer skin of the compartments is deformable and the interior of the compartments are in fluid communication with each other, the increased internal pressure caused by the decrease in volume will quickly be "absorbed" by all compartments, thus effectively allowing the deformation of the ground contacting surface so as to form a matching counterpart of the terrain. This, in turn, assures that the load on the shoe will, in most cases, still be evenly distributed along the entire ground contacting surface of the air cushion.

The compartments making up the cushion fluidly communicate with each other through external tubing having numerous three-way tube junctions (T-type or Y-type fittings). The external placement of the tubes and the accompanying fittings render the minefield shoe vulnerable to failures associated with deflation. Inadvertent and catastrophic deflation can occur when such a tube is accidentally snagged by a foreign object, such that the tube is separated from a fitting, or such that the tube is punctured or torn (e.g., by a sharp object on the ground or by excessive wear. A tube blowout or a seal failure may also occur as a result of an overly-high internal pressure, e.g., from over-inflation.

Perhaps the greatest disadvantage of the minefield shoe taught by U.S. Pat. No. 4,611,411 to Ringler, et al., is the susceptibility of the gas cushion to puncturing. Since the compartments of the cushion are designed to be fluidly communicable, in order to provide improved ground contacting and weight distribution, and failure within any one of the compartments (or tubes and fittings) results in substantially immediate and catastrophic deflation of the entire cushion, thereby nullifying the detonation risk-reducing properties of the shoe, and unexpectedly subjecting the user to various kinds of life-threatening dangers.

There is therefore a recognized need for, and it would be highly advantageous to have, a minefield shoe that achieves superior ground contact, like that of U.S. Pat. No. 4,611,411, but is highly robust and reliable. It would be of specific advantage for such a minefield shoe to have lower susceptibility to being punctured and to maintain satisfactory function even after being punctured. It would be of further advantage for such a minefield shoe to exhibit improved performance, in terms of weight distribution, even relative to the minefield shoe taught by the above-referenced application. Finally, it would be of further advantage for such a minefield shoe to be simple to manufacture, lightweight, compact, and easy to store and to inflate.

SUMMARY OF THE INVENTION

According to the teachings of the present invention there is provided a minefield shoe for reducing the danger of accidental detonation of a land mine by a wearer of the shoe, including: (a) a cushion including a plurality of inflatable compartments, the cushion having, when inflated, at least one flexible, substantially flat, ground-contacting surface extending across the compartments; (b) passages, disposed within the cushion, for providing fluid communication between the compartments, and (c) means for attaching the shoe to a boot of the wearer, wherein each of the compartments is in fluid communication with at least one other compartment, via the passages, so as to prevent any significant increase in internal pressure of any one of the compartments resulting from a decrease in internal volume of another compartment, thereby to allow deformation of the ground-contacting surface to form a matching counterpart of terrain engaged by the shoe, while maintaining a substantially even distribution of the load on the shoe along all of the ground-contacting surface.

According to further features in preferred embodiments of the invention described below, the passages include a tubular fitting.

According to still further features in preferred embodiments of the invention described below, the passages include a fitting having a substantially rectangular external profile.

According to still further features in preferred embodiments of the invention described below, the cushion includes at least one additional inflatable compartment that is fluidly isolated from and disposed above the plurality of inflatable compartments.

According to still further features in preferred embodiments of the invention described below, the additional compartment is a plurality of top compartments, each of the top compartments being in communication with at least one other top compartment.

According to still further features in preferred embodiments of the invention described below, the top compartments have passages, disposed within the cushion, for effecting fluid communication between the compartments.

According to still further features in preferred embodiments of the invention described below, the minefield shoe further includes: (d) at least one rigid tread member attachable to an upper surface of the cushion for evenly distributing a load of the wearer along the cushion and across a top surface of the compartments.

According to another aspect of the present invention there is provided a minefield shoe for reducing the danger of accidental detonation of a land mine by a wearer of the shoe, including: (a) a cushion including: (i) an inflatable top compartment, and (ii) an inflatable bottom compartment, for providing the cushion, when inflated, with at least one flexible, substantially flat, ground-contacting surface, the top compartment being disposed substantially on top of the bottom compartment, the top compartment being fluidly sealed from the bottom compartment; (b) at least one rigid tread member attachable to an upper surface of the cushion for evenly distributing a load of the wearer along the cushion and across a top surface of the top compartment, and (c) means for attaching the shoe to a boot of the wearer, wherein even with the bottom compartment in a deflated state, the cushion maintains a substantially even distribution of the load on the shoe along all of the ground-contacting surface.

According to still further features in preferred embodiments of the invention described below, the inflatable bottom compartment is a plurality of compartments, each of the compartments being in communication with at least one other compartment.

According to still further features in preferred embodiments of the invention described below, the compartments have passageways, disposed within the cushion, for effecting fluid communication between the compartments.

According to still further features in preferred embodiments of the invention described below, the inflatable top compartment is a second plurality of compartments, each of the compartments being in communication with at least one other compartment in the second plurality of compartments.

According to still further features in preferred embodiments of the invention described below, the flexible, substantially flat, ground-contacting surface is bonded to a bottom surface of the bottom compartment to form an integral sheet.

According to still further features in preferred embodiments of the invention described below, the flexible, substantially flat, ground-contacting surface is loosely attached to a bottom surface of the bottom compartment.

According to still further features in preferred embodiments of the invention described below, the ground-contacting surface is designed and optimized solely for maximal flexibility.

According to another aspect of the present invention there is provided a method for producing an inflatable minefield shoe for maintaining an evenly-distributed load on terrain, including the steps of: (a) providing at least two sheets, each sheet including a fabric layer and an impermeable coating adhering thereto; (b) fixing the sheets in a substantially parallel and substantially contacting disposition; (c) bonding the sheets in a series of pre-determined locations, so as to form a plurality of pockets, each of the pockets being in fluid communication with at least one other pocket, wherein the plurality of pockets, upon inflation, enables a ground-contacting surface of the minefield shoe to maintain a substantially even distribution of the load along the ground-contacting surface.

According to further features in preferred embodiments of the invention described below, the bonding is effected by means of high-frequency welding and an electrode.

According to still further features in preferred embodiments of the invention described below, the bonding is effected by means of heat-sealing.

According to still further features in preferred embodiments of the invention described below, the pockets are in fluid communication via passageways disposed within the plurality of pockets.

According to still further features in preferred embodiments of the invention described below, the passageways are formed by temporary insertion of a strip between the sheets, at predetermined locations.

According to still further features in preferred embodiments of the invention described below, each of the passageways is formed by disposing a tubular element between the sheets.

According to still further features in preferred embodiments of the invention described below, the tubular element is bonded to the sheets prior to step (c).

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a side view of the minefield shoe disclosed by U.S. Pat. No. 4,611,411 to Ringler, et al., attached to the boot of the wearer;

FIG. 2 shows one of the air cells of the minefield shoe of FIG. 1, along with the tubing structure for interconnecting this cell with the other cells of the air cushion;

FIG. 3 is a cross-sectional view of the long side of the air cushion portion of the inventive minefield shoe;

FIGS. 4*a* and 4*b* are cross-sectional views of the short side of the air cushion portion of the inventive minefield shoe, in which fittings for the interconnecting passageways between the inflated compartments are revealed;

FIG. 5 is a side view of another aspect of the minefield shoe of the present invention, having two levels of inflated compartments;

FIG. 6 is a schematic illustration of a minefield shoe disposed on a mine detonator plate in which the shoe has poor ground-contacting flexibility (FIG. 6*a*) and improved ground-contacting flexibility (FIG. 6*b*);

FIG. 7 is a schematic, exploded cross-sectional view of the various layers that make up the top and bottom levels of the gas cushion according to one embodiment of the present invention;

DESCRIPTION OF THE PREFERRED EMBODIMENTS

Figures 8A, 8B:
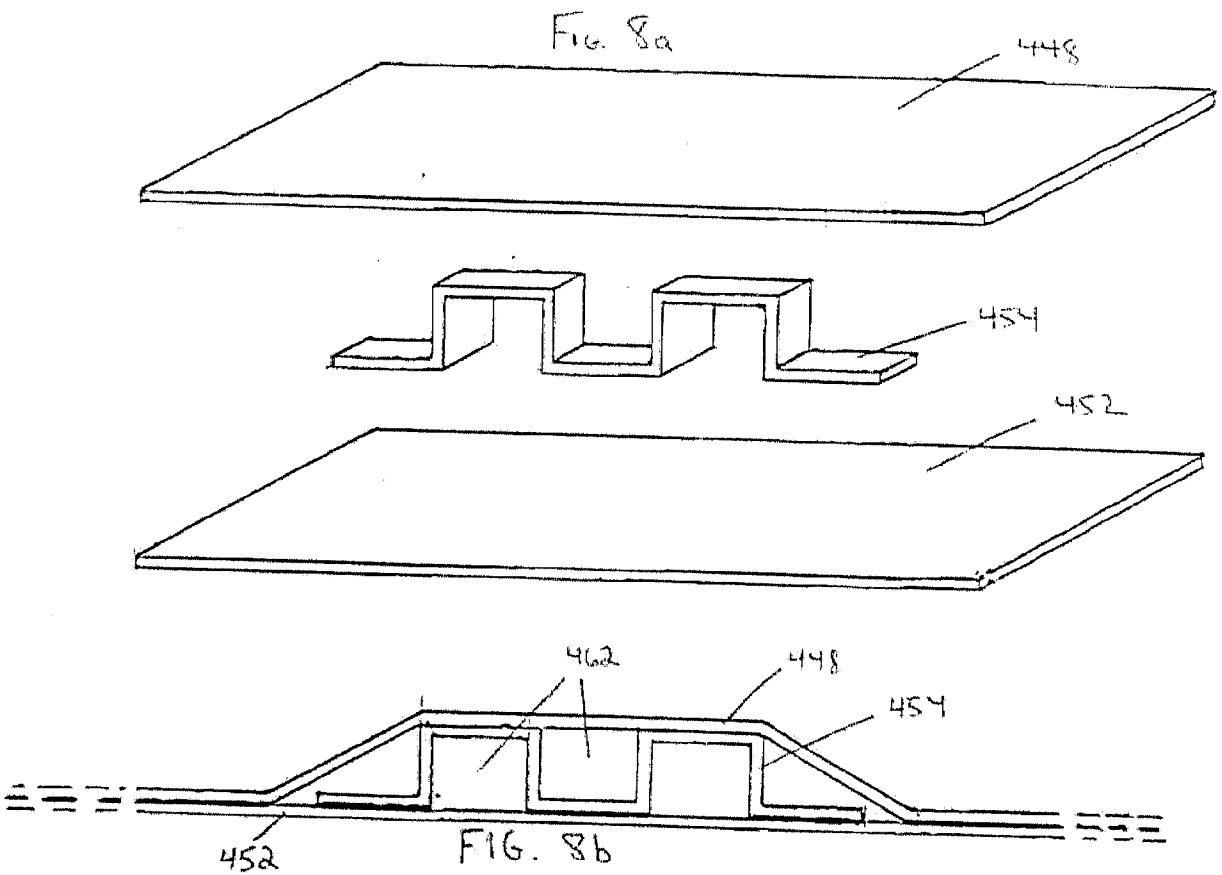
FIG. 8*a* is a schematic illustration of a top sheet and a bottom sheet of an inventive gas cushion, and a bridge-like device for attaching therebetween.
FIG. 8*b* is a schematic cross-sectional view of the components of FIG. 8*a*, after bonding, in which the bridge-like device forms an internal passageway for fluid communication between adjacent cushions.

The principles and operation of the minefield shoe according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawing. The invention is capable of other embodiments or of being practiced or carried out in various ways. Also, it is to be understood that the phraseology and terminology employed herein is for the purpose of description and should not be regarded as limiting.

Referring now to the drawings, FIG. 1 is a side view of a minefield shoe, attached to the boot of a wearer, disclosed by U.S. Pat. No. 4,611,411 to Ringler, et al., which is incorporated by reference for all purposes as if fully set forth herein. The prior-art minefield shoe includes an inflatable air cushion 2 composed of a plurality of chambers or compartments 4. When inflated, the compartments form an air cushion having upper and ground contacting surfaces that are substantially flat. The air cushion 2 may be made of an inner, inflatable, rubber, neoprene or the like, balloon 6 and of an outer abrasion and cut resistant fabric 8. The air cushion may otherwise be composed of an integral single layer of material that is impermeable to gas and having an outer surface which is abrasion and cut resistant. Such a layer should be capable of limiting the extent to which the compartments are inflated and of keeping their volume substantially constant below a certain maximum. The interiors of the compartments communicate with each other by means of tubing 10 extending along the sides of the compartments 4. One end of tubing 10 may be fixedly closed for example, by folding the tubing edge and clamping the same in its folded configuration as seen at 16, while the other end of tubing 10 is provided with a valve (not shown), for inflation and deflation of the air cushion.

The minefield shoe taught by U.S. Pat. No. 4,611,411 to Ringler, et al., further includes a rigid tread surface 20 for evenly distributing the wearer's weight along the air cushion on top of each of the compartments 4. While the illustrated tread surface 20 is designed to facilitate compacting the mine-field shoe for carrying and transporting purposes, it is disclosed that the tread surface could also be embodied by a single, rigid plate having an overall surface area substantially the same as that of the upper surface of the air cushion. The tread surface 20 is fitted with straps 26 arranged for easy attachment to a wearer's boot 28. Although the multiple-compartment air cushion 2, the tubing 10 interconnecting the compartments, and the tread surface 20 essentially form the mine-field shoe of the instant invention, it has been found advantageous to attach to the upper major flat surface of each compartment, a support plate 30, thus effecting an even more uniform weight distribution along the entire surface area of the air cushion.

The shoe is of the foldable type, including an inflatable gas cushion composed of a plurality of chambers or compartments. When inflated, the compartments form a gas cushion having upper and ground contacting surfaces that are substantially flat.

FIG. 2 shows an air cell 86 of U.S. Pat. No. 4,611,411 along with T-connectors 116 in the first four cells, an L-connector 118 in the last cell, and four intermediate rubber tubing sections 120. A first tubing section 122 is provided with a schematically indicated pinch cock 124.

As mentioned hereinabove, the minefield shoe taught by U.S. Pat. No. 4,611,411 is highly prone to failures associated with deflation, and more specifically, deflation associated with the external placement of the tubes and the large plurality of accompanying fittings, each having two or three joints. Each joint presents a sealing problem that detracts from the reliability of the device. Moreover, deflation can also occur when the tubing is caught by a foreign object, such that the tube is separated from a fitting, punctured by a nail or other sharp object, or torn (e.g., due to excessive wear).

Although it is disclosed by U.S. Pat. No. 4,611,411 that the air cushion can be inflated by means of a pump or by means of a pressurized gas bottle, it has been the experience of the present inventors that such means are inappropriate, unless the inflation is performed in a very slow, gradual, controlled manner. When the inflation is performed in a less gradual fashion, the device is highly susceptible to a sealing failure, such as a tubing section 120 becoming detached from a T-connector 116, because the external tubing has a relatively small diameter, and further in view of the numerous fittings, all of which represent weak points, particularly under high-pressure conditions.

By sharp contrast, the minefield shoe of the present invention has compartments that fluidly communicate by means of passages that are internal to the cushion structure. These internal passages are shown in cross-sectional views of the long side (FIG. 3) and short side (FIGS. 4*a*–4*b*) of the air cushion of the inventive device. As in the prior art device, the inventive minefield shoe includes an inflatable air cushion 202 composed of a plurality of chambers or compartments 204. When inflated, the compartments form an air cushion having upper and ground contacting surfaces that are substantially flat. Unlike the prior-art minefield shoe, however, the interiors of the compartments 204 communicate with each other by a series of internal passages 210.

Internal passages 210 are inherently protected by compartments 204, and are thus not vulnerable to damage and/or failure due to external sharp objects, rough use under battlefield conditions, and blowouts or leakage due to overinflation, excessive pressures, etc. There is no external tubing for linking compartments 204, such that the serious problems associated with external tubes and fittings are eliminated.

In simplest form, internal passages 210 are one or more sealing gaps disposed in each of internal walls 220. It has been found to be advantageous, however, to place a fitting in internal passage 210, as shown in FIGS. 4*a* and 4*b*. In FIG. 4*a*, the fitting is a tubular orifice 222. FIG. 4*b* is a schematic representation of a multiple-orificed fitting 224. Preferably, multiple-orificed fitting 224, and tubular orifice 222 have a rectangular profile.

An additional inventive aspect of the minefield shoe of the present invention is illustrated in a schematic side view in FIG. 5. Minefield shoe 300 has a top level 310 of gas-containing compartments 312 and a bottom level 320 of gas-containing compartments 322. Gas-containing compartments 312 in top level 310 fluidly communicate with each other, preferably by means of internal passages, such as multiple-orificed fitting 224 shown in FIG. 4*b*. Similarly, gas-containing compartments 322 in bottom level 320 fluidly communicate with each other. However, top level 310 is fluidly sealed from bottom level 320. In the event that one or more of gas-containing compartments 322 in bottom level 320 is punctured, top level 310 remains pressurized and intact, thereby maintaining the main safety function of the minefield shoe. Hence, the reliability of minefield shoe 300 is substantially improved relative to the shoe disclosed by U.S. Pat. No. 4,611,411.

Preferably, top level 310 and bottom level 320 each have a dedicated valve (316, 326, respectively) for inflation and deflation. However, it will be appreciated by one skilled in the art that various configurations are possible.

In a preferred embodiment, top level 310 and bottom level 320 are fluidly isolated by at least one self-adjusting partition 315. Self-adjusting partition 315 is typically a flexible, loosely disposed layer that serves both as a bottom wall of top level 310 and as a top wall for bottom level 320. It has been found to be advantageous to fill top level 310 with at least 60% of the total amount of gas used to inflate minefield shoe 300, and more preferably, between ⅔ and ¾ of the total amount of gas. Consequently, in the event of a puncture in bottom level 320, the bulk of the gas remains contained in top level 310.

Moreover, when self-adjusting partition 315 is a flexible, loosely disposed layer, attached approximately near the vertical middle (at a height of H/2) of levels 310, 320, self-adjusting partition 315 is distended below the vertical middle, upon inflation, as top level 310 and bottom level 320 reach an identical pressure. In the event that bottom level 320 is punctured, top level 310 continues to provide a thick cushion of pressurized air, such that the weight distribution functionality of the shoe is substantially maintained.

Yet another inventive aspect of the minefield shoe of the present invention will be made apparent in comparison to the prior art and in conjunction with the schematic illustration of a minefield shoe contacting a mine detonator plate (FIGS. 6*a* –6*b*). Perhaps the most significant feature of the minefield shoe taught by U.S. Pat. No. 4,611,411 to Ringler, et al., is the improved ground-conforming property relative to the rigid snowshoe-type minefield shoe described hereinabove. FIG. 6*a* shows a somewhat flexible bottom surface 350 of a minefield shoe that insufficiently conforms to a mine detonator plate (or mine trigger) 352 protruding from the ground. Although the weight distribution is improved with respect to a rigid bottom surface, the surface area 354 that is unsupported by ground surface 356 is relatively large, such that the force exerted down on the detonator plate surface is high. Consequently, the risk of detonation is correspondingly high. In FIG. 6B, the bottom surface 360 is more flexible, conforming more snugly to detonator plate 352. The result is improved performance (weight distribution): the surface area 364 that is unsupported by ground surface 356 is decreased, such that less weight is placed on detonator plate 352.

It is thus a cardinal design principle to make the bottom surface of the minefield shoe as flexible as possible. The bottom surfaces of the minefield shoe taught by U.S. Pat. No. 4,611,411 are designed not only for flexibility, but for cut and abrasion resistance as well. Alternatively, the air cushion is composed of a single integral layer of material that is impermeable to gas and having an outer (bottom) surface that is abrasion and cut resistant. In both cases, the additional design constraints result in a bottom surface that is far from optimal in terms of flexibility and weight distribution on uneven terrain. The flexibility compromise is particularly severe because a puncture or tear in the bottom surface completely destroys the efficacy of the minefield shoe. By sharp contrast, and as developed hereinabove, the minefield shoe of the present invention has a two-level design in which the levels are fluidly incommunicable, such that the shoe remains completely functional in the event of a tear or puncture. The ramification, from a design standpoint, is manifest: the requisite double design constraint of flexibility and toughness in the shoe taught by U.S. Pat. No. 4,611,411 is now substantially decoupled. In the minefield shoe of the present invention, the toughness constraint on the bottom surface is greatly relaxed, such that the bottom surface can be designed to have increased flexibility, thereby improving the ground-conforming property and hence, performance.

FIG. 7 is a schematic, exploded cross-sectional view of the various layers that make up the top and bottom levels of the gas cushion according to one embodiment of the present invention. A cushion 410 contains a top gas compartment 417 and a bottom gas compartment 420. Sheet 412 defines the top of compartment 417, sheet 422 defines the bottom of compartment 420, and sheet 418 defines the bottom of compartment 417 and the top of compartment 420.

Sheets 418 and 422 are made of any impermeable, and preferably flexible synthetic material such as PVC, polyurethane, or nylon fabric. Sheet 412 is composed of a fabric 414 having an impermeable coating 416 on the underside thereof. Bottom sheet 426 is composed of a porous and flexible fabric that is loosely attached (e.g., sewn) to the bottom surface of sheet 422. Bottom sheet 426 is sufficiently loose and pliable so as to conform freely to protruding objects that the shoe wearer might step on, such as a mine detonator pin, thereby improving the performance of the inventive minefield shoe.

FIG. 8*a* is a schematic illustration of a top sheet 448 and a bottom sheet 452 of an inventive gas cushion, and a bridge-like device 454 for attaching therebetween. FIG. 8*b* is a schematic cross-sectional view of the components of FIG. 8*a*, after bonding, in which bridge-like device 454 forms internal passageways 462 for fluid communication between adjacent cushions.

Figure 9:
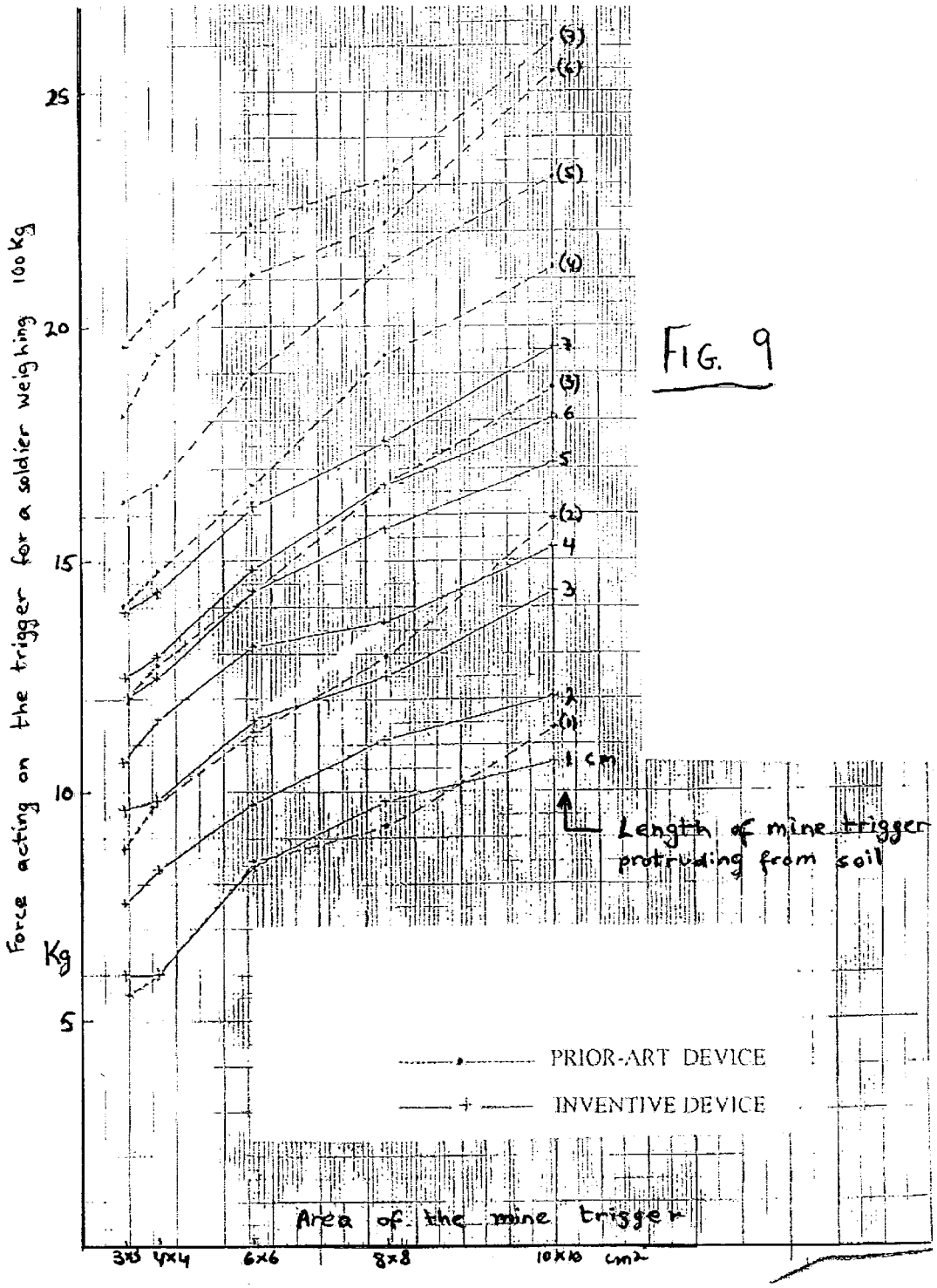
FIG. 9 is a graph illustrating the improved weight distribution of the inventive minefield shoe as compared with the minefield shoe disclosed by U.S. Pat. No. 4,611,411, as a function of mine trigger surface area, and for varying length of mine trigger protruding from the soil.

FIG. 9 is a graph illustrating the improved weight distribution of the inventive minefield shoe as compared with the minefield shoe disclosed by U.S. Pat. No. 4,611,411. The X-axis represents the force acting on the mine trigger, for a soldier weighing 100 kg. The Y-axis represents the area of the mine trigger, in $cm^2$. Multiple plots are presented, as a function of the length (in cm) of mine trigger protruding from the soil. It is evident that the force acting on the mine trigger increases with increasing area of the mine trigger, and with increasing of the length of mine trigger protruding from the soil, for both the inventive device and the prior-art device. Significantly, with the inventive device, lower forces are exerted on the mine trigger, relative to the shoe disclosed by U.S. Pat. No. 4,611,411, at virtually every measured point on the graph. Without wishing to be bound by theory, this superior performance is attributed, at least in part, to the superior flexibility of the bottom surface of the inventive device. Yet another aspect of the present invention is a manufacturing method for producing a minefield shoe having the basic design taught herein. Whereas U.S. Pat. No. 4,611,411 to Ringler, et al., teaches a device having individual balloons or compartments, fabric housing for the compartments, and a large plurality of tubes and fittings for fluid communication between the compartments, the design of the present invention allows for production using a simple, inexpensive, and highly-efficient bonding process. Two sheets of polyester or nylon fabric, coated with polyurethane, are held together, with the coated sides facing and contacting one another. It will be appreciated by one skilled in the art that other suitable fabrics and coatings may be utilized. The sheets are then bonded at a pre-determined interval along the length of the sheets to form a series of pockets in a single unit-operation. The bonding is preferably effected by high-frequency welding using a single top electrode, or by various, conventional heat-sealing techniques.

The passages for fluid communication between the pockets, described hereinabove, may be effected in several ways, including:

(1) Prior to the heat sealing operation, a strip of proper dimensions (e.g., 7 mm by 30 mm) is temporarily inserted between the sheets during the heat-sealing process, in order to provide a suitable internal gap or passageway between pockets. Typically the strip is left in place only during the welding operation.

(2) Prior to the heat sealing operation, fittings such as tubular orifice 222 or multiple-orificed fitting 224 (see FIGS. 4*a*–4*b*) are inserted between the sheets and are preferably bonded to the sheets at intervals corresponding to a designed, pre-determined length of each pocket. It is presently preferred to use a multiple-orificed fitting 224 having a rectangular profile. The fittings provide the pockets with a mechanically strong passageway that assures full fluid communication between pockets, even under extenuating circumstances (e.g., significant overinflation of the pockets).

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, no citation or identification of any reference in this application shall be construed as an admission that such reference is available as prior art to the present invention.

What is claimed is:

1. A minefield shoe for reducing the danger of accidental detonation of a land mine by a wearer of the shoe, the shoe comprising:

(a) a cushion including a plurality of inflatable compartments, said cushion having, when inflated, at least one flexible, substantially flat, ground-contacting surface extending across said compartments;

(b) passages, disposed within said cushion, for providing fluid communication between said compartments, and (c) means for attaching the shoe to a boot of the wearer, wherein each of the compartments of said cushion is in fluid communication with at least one other of said compartments, via said passages, so as to moderate any increase in internal pressure of any one of said compartments resulting from a decrease in internal volume of said one compartment, thereby to allow deformation of said ground-contacting surface to form a matching counterpart of terrain engaged by the shoe, while maintaining a substantially even distribution of said load on the shoe along all of said ground-contacting surface, and wherein said passages are disposed and configured such that said fluid communication between said compartments is effected solely within a volume externally bounded by said plurality of inflatable compartments.

2. The minefield shoe of claim 1, wherein said passages include a tubular fitting.

3. The minefield shoe of claim 1, wherein said passages include a fitting having a substantially rectangular profile.

4. The minefield shoe of claim 1, said cushion including at least one additional inflatable compartment, wherein said additional compartment is fluidly isolated from and disposed above said plurality of inflatable compartments.

5. The minefield shoe of claim 4, wherein said additional compartment is a plurality of top compartments, each of said top compartments being in communication with at least one other of said top compartments.

6. The minefield shoe of claim 5, said top compartments having passages, disposed within said cushion, for effecting fluid communication between said compartments.

7. The minefield shoe of claim 1, further comprising:

(d) at least one rigid tread member, configured to attach to an upper surface of said cushion for evenly distributing a load of the wearer along said cushion and across a top surface of said compartments.

8. The minefield shoe of claim 1, wherein said passages are disposed and configured such that said fluid communication between said compartments is effected solely within said plurality of inflatable compartments.

9. The minefield shoe of claim 1, further comprising:

(d) at least one rigid tread member attachable to an upper surface of said cushion for evenly distributing a load of the wearer along said cushion and across a top surface of all of said compartments.

10. A minefield shoe for reducing the danger of accidental detonation of a land mine by a wearer of the shoe, the shoe comprising:

(a) a cushion including:

(i) an inflatable top compartment, and (ii) an inflatable bottom compartment, for providing said cushion, when inflated, with at least one flexible, substantially flat, ground-contacting surface, said top compartment being disposed substantially on top of said bottom compartment, said top compartment being fluidly sealed from said bottom compartment;

(b) at least one rigid tread member attachable to an upper surface of said cushion for evenly distributing a load of the wearer along said cushion and across a top surface of said top compartment, and (c) means for attaching the minefield shoe to a boot of the wearer, wherein even with said bottom compartment in a deflated state, said cushion maintains a substantially even distribution of said load on the shoe along all of said ground-contacting surface, said ground-contacting surface having a ground-contacting area greater than a ground-contacting area of an ordinary shoe, such that a pressure exerted on a ground surface underneath said ground-contacting area is reduced with respect to said ground-contacting area of said ordinary shoe.

11. The minefield shoe of claim 10, wherein said inflatable bottom compartment is a plurality of compartments, each of said compartments being in communication with at least one other of said compartments.

12. The minefield shoe of claim 11, said compartments having passageways, disposed within said cushion, for effecting fluid communication between said compartments.

13. The minefield shoe of claim 11, wherein said inflatable top compartment is a second plurality of compartments, each of said compartments being in communication with at least one other of compartments in said second plurality of compartments.

14. The minefield shoe of claim 10, wherein said flexible, substantially flat, ground-contacting surface is bonded to a bottom surface of said bottom compartment to form an integral sheet.

15. The minefield shoe of claim 10, wherein said flexible, substantially flat, ground-contacting surface is loosely attached to a bottom surface of said bottom compartment.

16. The minefield shoe of claim 10, wherein said ground-contacting surface is designed and optimized solely for maximal flexibility.

17. The minefield shoe of claim 12, wherein at least one of said passageways includes a tubular element.

18. The method of claim 17, wherein said tubular element has a rectangular external profile.

19. A minefield shoe for reducing the danger of accidental detonation of a land mine by a wearer of the shoe, the shoe comprising:

(a) a cushion including a plurality of inflatable compartments, said cushion having, when inflated, at least one flexible, substantially flat, ground-contacting surface extending across said compartments;

(b) passages, disposed within said cushion, for providing fluid communication between said compartments, and (c) means for attaching the shoe to a boot of the wearer, wherein each of the compartments of said cushion is in fluid communication with at least one other of said compartments, via said passages, so as to moderate any increase in internal pressure of any one of said compartments resulting from a decrease in internal volume of said one compartment, thereby to allow deformation of said ground-contacting surface to form a matching counterpart of terrain engaged by the shoe, while maintaining a substantially even distribution of said load on the shoe along all of said ground-contacting surface, said cushion including at least one additional inflatable compartment, said additional compartment configured to be fluidly isolated from and disposed above said plurality of inflatable compartments.

20. The minefield shoe of claim 19, wherein said additional compartment is a plurality of top compartments, each of said top compartments being in communication with at least one other of said top compartments.

21. The minefield shoe of claim 20, said top compartments having passages, disposed within said cushion, for effecting fluid communication between said compartments.

* * * * *